US005328295A

United States Patent [19]

Allen

[11] Patent Number: 5,328,295

[45] Date of Patent: Jul. 12, 1994

[54] TORSIONAL AUTOMATIC GRADE CONTROL SYSTEM FOR CONCRETE FINISHING

[75] Inventor: J. Dewayne Allen, Paragould, Ark.

[73] Assignee: Allen Engineering Corporation, Paragould, Ark.

[21] Appl. No.: 147,302

[22] Filed: Nov. 5, 1993

Related U.S. Application Data

[63] Continuation-in-part of Ser. No. 903,936, Jun. 26, 1992, Pat. No. 5,288,166.

[51] Int. Cl.[5] ..... E01C 19/40

[52] U.S. Cl. ..... 404/84.1; 404/118; 404/120

[58] Field of Search ..... 404/84.1, 114, 118, 404/120

[56] References Cited

U.S. PATENT DOCUMENTS

| | | | |
|---|---|---|---|
| 2,314,985 | 3/1943 | Jackson | 94/45 |
| 2,542,979 | 2/1951 | Barnes | 94/48 |
| 2,651,980 | 9/1953 | Wells et al. | 94/48 |
| 2,693,136 | 11/1954 | Barnes | 94/48 |
| 3,095,789 | 7/1963 | Melvin et al. | 94/45 |
| 4,030,873 | 6/1977 | Morrison | 425/456 |
| 4,105,355 | 8/1978 | King et al. | 404/114 |
| 4,316,715 | 2/1982 | Allen | 425/456 |
| 4,340,351 | 7/1982 | Owens | 425/456 |
| 4,349,328 | 9/1982 | Allen | 425/456 |
| 4,363,618 | 12/1982 | Allen | 425/458 |
| 4,375,351 | 3/1983 | Allen | 425/456 |
| 4,386,901 | 6/1983 | Morrison | 425/456 |
| 4,650,366 | 3/1987 | Morrison | 404/114 |
| 4,798,494 | 1/1989 | Allen | 404/114 |
| 4,854,769 | 8/1989 | Fukukawa et al. | 404/72 |
| 4,861,189 | 8/1989 | Fukukawa et al. | 404/83 |
| 4,930,935 | 6/1990 | Quenzi et al. | 404/75 |
| 5,039,249 | 8/1991 | Hansen et al. | 404/84 |

*Primary Examiner*—Mark Rosenbaum
*Assistant Examiner*—John M. Husar
*Attorney, Agent, or Firm*—Stephen D. Carver; Trent C. Keisling

[57] ABSTRACT

A torsionally stabilized automatic grade control system for finishing plastic concrete is capable of controlling a variety of different elongated, multi-section concrete finishing tools such as a vibratory screed or the like, with or without forms. Skis that support the device facilitate sliding, winch driven movement over and through plastic concrete. Spaced apart, vertically upwardly extending towers support the device; they are disposed periodically along the length of the finishing tool. Each tower comprises a pair of extensible, spaced apart stanchions hinged to the skis and disposed on opposite sides of the tool. An upper strut extends between the stanchions. A sleeve coaxially fitted to each stanchion is synchronized with the opposite sleeve by a rigid transverse bridge. The bridge is adjustably coupled to the strut. The upper portion of the stanchions comprises a hydraulic cylinder. Each cylinder is controlled by an adjacent sensor secured to the strut to maintain the attached tool level. The sensors detect a preestablished laser beacon or the like. Winches move the device along the plastic concrete by spooling cables secured to a fixed point. As the stanchions extend or retract the hinged skis deflect to localize movement of the screed.

19 Claims, 6 Drawing Sheets

TORSIONAL AUTOMATIC GRADE CONTROL SYSTEM FOR CONCRETE FINISHING

CROSS-REFERENCE TO RELATED APPLICATION

This is Continuation-in-Part of prior patent application Ser. No. 07/903,936, filed Jun. 26, 1992, now U.S. Pat. No. 5,288,166, entitled: Laser Operated Automatic Grade Control System for Concrete Finishing.

BACKGROUND OF THE INVENTION

1. Field of the Invention

This invention relates generally to concrete finishing devices that provide smooth, continuous concrete surfaces of a substantially uniform grade and finish. More particularly, this invention relates to laser-operated, automatic grade controlling devices for concrete finishing of the type classified in U.S. Class 404, subclasses 84, 114, 118 and/or 120.

2. The Prior Art

As recognized by those skilled in the concrete finishing arts, after concrete is initially placed during construction, it must be appropriately finished to give it a smooth, flat, homogeneous and correctly textured surface and appearance. Numerous finishing devices, including screeds, have long been in use throughout the industry for treating plastic concrete. Known prior art systems include "bull" floats, various forms of finishing boards, strike-offs, pans, plows, blades and the like. Bull floats essentially comprise a flat wooden board attached to a handle, much like a broom handle. These floats are manipulated by a single worker. Strike-offs contact rough, unfinished plastic concrete with a rigid leading edge to initially form, level and grade.

It is well known that either external or internal vibration facilitates concrete settling and finishing, and many vibrating systems have previously been proposed. In general, vibration promotes the attainment of a smooth, uniform product. Vibration during strike-off and subsequent screeding helps to settle the concrete and eliminate entrapped air voids. Vibration helps to densify and compact the concrete. Vibrational screeding also draws out excess water thereby increasing the structural integrity of the placed concrete. A fine layer of component cement and sand aggregate is raised to the surface by vibration along with the excess water. This cementitious slurry aids subsequent fine finishing. Often screeds extend between and rest upon the forms between which the plastic concrete is actually confined. Forms constrain the concrete until it is set, and they often provide a working structural support for the typical screed or finishing machine.

The selection of strike-off design and vibration technique for a particular machine is based upon a variety of factors, such as the characteristics of the concrete. Variables relating to concrete finishing result from the selected type and percentage of aggregate, sand, cement, admixtures, and water. Temperature, slab thickness, slump and placement method also vary the application procedure. Those skilled in the art will recognize that the selected finishing equipment must be appropriately mated to the job demands.

Thus in screeding, for example, an optimum strike-off design and vibration technique must be chosen based on the condition of the concrete and the desired results. If high slump concrete is to be screeded, a floating pan would be ideal. For finishing relatively dryer concrete, a heavier twin-bladed screed or strike-off might be more desirable. In all cases it is desirable to insure the development of a proper grade. In other words, the plane of the installed concrete surface must be properly aligned and oriented.

I previously have been involved with several patents in the art of concrete placement and finishing. Typical is a prior art self-propelled "triangular truss" screed that rides upon forms seen in U.S. Pat. No. 4,349,328. Additionally, U.S. Pat. No. 4,798,494 discloses a floating vibratory screed intended to facilitate the finishing of concrete with or without forms. Finally, Allen prior U.S. Pat. Nos. 4,316,715; 4,363,618 and 4,375,351 and the various references cited and discussed therein are germane to the general technology discussed herein. The parent to the present case discloses a laser beacon directed screed control system. All the above patents have been assigned to the same assignee as the present case.

U.S. Pat. Nos. 4,650,366 and 4,386,901 disclose screeds capable of formless, self-supporting or floating operation. The latter patent speaks to a relatively heavy triangular truss screed adapted to be operated by two workmen without the use of forms. U.S. Pat. No. 4,650,366 discloses a light weight, portable vibrating screed including a central, extruded beam element. A floating screed manufactured by Les Placements Paro of Canada, although it is not necessarily prior art and is apparently unpatented, is believed relevant. It includes a floating pan that is physically offset from, and adjustably coupled to, a parallel and spaced-apart strike-off assembly.

U.S. Pat. No. 3,431,336 discloses a floating vibrating finishing screed adapted for use upon plastic concrete. U.S. Pat. No. 2,314,985 discloses a vibratory hand screed including a central, vibrated pan that is apparently adapted for use upon plastic concrete without support upon confining forms.

Another prior art floating screed of general relevance is disclosed in a video tape produced by the American Concrete Institute and The Portland Cement Association, entitled "Finishing Concrete Flatwork," that bears a Copyright date of 1984. Other prior art screeds, generally of the "form-riding" type, include those screeds disclosed in U.S. Pat. Nos. 4,340,351; 4,105,355; 2,651,980; 2,542,979; 3,095,789; 2,693,136; and 4,030,873.

Lasers are commonplace on the modern construction site. They are employed in surveying, earthwork and general layout operations. Fukukawa U.S. Pat. Nos. 4,861,189 and 4,854,769 disclose a system for paving inclined and/or curved surfaces. This system employs anchor vehicles and paving vehicles. The paving vehicles are secured to the anchor vehicles by wires. The connections of the wires to the anchor vehicles are controlled by a laser sensing device. Microcomputers control the shape of the paving devices to create compound and complex curves in paved surfaces.

Two devices employing a vehicle with a boom terminating in a screed are disclosed in Hansen U.S. Pat. No. 5,039,249 and Quenzi U.S. Pat. No. 4,930,935. Each of these patents relates to an anchor vehicle and a telescoping boom extending horizontally from the vehicle. The boom terminates in a screeding device that may also employ augers and vibrators. A second Quenzi U.S. Pat. No. 4,978,246 discloses an apparatus and method for controlling laser guided machines. This patent relates to an improvement to the above Quenzi patent.

Owens U.S. Pat. No. 4,752,156 discloses a manually operated laser guided portable screed. This invention is basically a screed with a pair of laser sensors mounted to it. Operators manually adjust the height of the screed as they draw it across placed concrete in response to a signal from the laser sensor. All of the above mentioned devices use a stationary laser beacon that projects laser light in a 360 degree plane.

However, none of the prior art devices known to us provides a satisfactorily efficient system for controlling the finished elevation of a concrete surface without the use of forms or heavy machinery. No prior art device provides for finishing plastic concrete to a uniform elevation or at a uniform angle of grade employing conventional portable, formless, floating screeds. Such screeds can be conveniently and concurrently used for vibrating, striking-off, and float finishing. Particularly, no device disclosed by the prior art is suitable for use within a building or in other confined areas. Additionally, prior art devices are restricted to a designed use and are not adaptable to a variety of uses.

The prior art devices cannot be combined to work in a gang configuration. Neither can the prior art devices be reduced to a limited number of components to facilitate use in tight spaces or to increase the efficiency of available resources. In conventional floating, vibratory screeds the relationship between the buoyancy of the pan, the plastic concrete's resultant surface tension, and the overall center of gravity of the apparatus is concurrently balanced. The prior art devices fail to take advantage of this balance.

Previously developed laser control systems for screeds employ hydraulic cylinders. In these devices, each station that monitors the remote laser beacon has a single sensor and an interconnected cylinder. There is one station at each end of the screed. Simple vertical displacements of the screed at one end can fail to adequately compensate for changes of the plane of the concrete or the underlying support strata from side to side and front to back. In other words, when grade changes are sensed, it may not be enough to simply lift or lower a screed end; the plane of the concrete may require torsional displacement of the screed to achieve the desired plane. Without such versatility, elevation compensation directed to one screed end can cause a responsive compensation in the other screed end and vice-versa. Unwanted screed oscillation or "rocking" can thus result as the opposite grade control stanchion attempts to compensate for sensed distortion. Similar front to back oscillations can also occur. As a result of the reaction and counter reaction, the screed will not smoothly assume a relatively stable, slowly changing orientation. Instead it may jerk and rock in an ineffectual fashion.

Hence, it is necessary to provide a grade control mechanism that satisfactorily controls the screed in a plane common to the resultant finished concrete, and in a plane perpendicular to the finished surface. In other words, it is desirous to not only control the elevation of the screed from end to end but also front to back (i.e., torsional control). This will allow minor adjustments at a "corner" of the screed. These adjustments should not adversely effect the opposing corner or the opposing edge of the screed. Such a device can change grade if necessary with little or no disruption of the finishing operation if the underlying surface will allow.

It is therefore desirous to provide a laser leveled screed that can independently adjust the leading and trailing edges of the screed (i.e., automatic torsional screed control). Each support tower end should be controlled by an independent laser sensing mechanism. Furthermore, it is desirous that each active side of the tower be mechanically isolated from the another so that minor torsional corrections in screed orientation do not result in oscillations.

SUMMARY OF THE INVENTION

My Torsional Automatic Grade Control System for Concrete Finishing automatically controls the elevation of concrete finishing tools without front-to-back oscillations. The device provides precise laser leveling to the selected finishing tool, such as a screed or the like, whether the area to be finished is great or small. The device is capable of being deployed within a limited area, and it may be deployed without forms. It is capable of operating a floating screed without detracting from the screed's inherent ability to balance the screed pan's buoyancy with the surface tension of the concrete. To accomplish this the device is designed to maintain the finishing tool's inherent center of gravity. My device uses a reference plane established by a laser light beam to sense variations in the level of the attached finishing tool. Multiple sensors each independently input data to control displacement of the present device.

Several frame elements of the selected finishing tool can be ganged together to form the desired length. The combined device slides on centrally flexible skis or sleds resting below the surface of the concrete. Spaced apart control towers extending upwardly from the skis or sleds support the finishing tool. The relative elevation of a remote laser beacon is detected by the device. In answer, the device adjusts the elevation of the tool in response to the laser to produce a smooth finish that is level or at a uniform grade.

The supporting ski rides on the rebar or underlying supporting strata. Each tower comprises a pair of vertically extensible stanchions pinned to an upper strut. A bridge assembly, sleeved to the stanchions, is interconnected to the strut and screed.

The extensible stanchions are connected to the ski by pins, allowing the stanchions to deflect relative to the ski. The lower portion of each stanchion is comprised of square tubing. The upper portion is comprised of a hydraulic cylinder or the like. The hydraulic cylinder is pinned to the strut. The pin securing the cylinder to the strut is generally perpendicular to the pin securing the lower portion of the strut to the ski.

A bridge assembly comprises a pair of sleeves slidably mated to the lower portion of the stanchions and a transverse bridge extending between them. The bridge is coupled to the finishing tool. A pair of adjustable columns extend between the bridge and the strut.

A remote laser beacon (or alternatively an optical beacon or the like) provides sighting reference signals. The skis or sleds slide along the sub-grade or on rebar laid down earlier. A laser sensor is associated with each stanchion. Each sensor is adjustably mounted on a mast adjacent the stanchion it guides. The mast is secured in a socket on the strut. The sensor is connected by a cable to a control panel.

The control panel is preferably shock mounted to the strut. The control panel interprets output from the sensors to control extension and retraction of the hydraulic cylinders, thus maintaining the screed at the proper elevation. Hydraulic winches or other towing devices are interconnected to the controls of the hydraulic cylinders to pull the device along the plastic concrete. Each winch is preferably mounted to a flange extending from a bridge assembly. The winches spool cables that are secured to a fixed point.

As mentioned above, a plurality of spaced apart towers can control a single elongated finishing tool. The beacon is established at a fixed elevation or angle of inclination. The towers are adjusted to initially obtain the desired tool elevation, and the proper hydraulic cylinder displacement. The sensors must be adjusted on the masts to obtain initial alignment of the laser and sensors. As the device moves over the surface of the concrete, the sensors output the relative elevation of the beacon to the control panel. The stanchions are extended or retracted to maintain the screed at the proper elevation. The displacement by extension or retraction of a stanchion is localized due to defection of the skis at their flexible connections and at the pins securing the skis to the stanchions.

Thus a fundamental object of my invention is to provide an improved laser-controlled, automatic grade fixing device for concrete placing and finishing that resists rocking and unstable oscillations.

A similar object is to provide an improved laser grade control system for concrete finishing equipment that torsionally controls the screed or blade.

Another object is to provide a grade control system for concrete finishing that gradually and smoothly effectuates grade control without jerking and rocking.

A basic object is to provide an automatic grade control system of the character described that can be used with a variety of concrete finishing mechanisms such as roller tube finishers, strike-offs, screeds, trowels, plows, pavers with shaped blades and the like to facilitate the placing and finishing of plastic concrete.

A still further object is to facilitate the formless placement of slabs on grades.

Another object is to simplify the placement of rebar.

A more particular object of the present invention is to provide a portable laser controlled grade fixing device and method for automated use of a self-floating vibrating screed for striking-off, float finishing, and vibrating plastic concrete without forms in a single pass.

A related object of the present invention is to provide a mechanism to manipulate a floating vibrating screed without the use of external leveling systems such as winches, cranes or the like.

A related object is to provide a leveling system of the character described that can be easily used with vibrating screeds comprising rotating shaft eccentrics, electric vibrators, pneumatic vibrators or other vibration techniques.

A further primary object of the present invention is to provide a laser control mechanism for concrete finishing devices which can independently control the elevation of an edge of the screed to which it is attached.

A further object of the present invention is to provide a screed control mechanism which is flexibly hinged such that movement of one portion of the mechanism does not adversely effect other portions of the screed or other mechanisms.

Another fundamental object of the present invention is to provide grade fixing device of the character described that can mount screeds of various widths and lengths.

Yet another object of the present invention is to ease the use of a screed (or other concrete finishing tools) with relatively high slump or low slump concrete.

Another object is to provide a device to avoid slewing of a screed during float finishing of concrete.

Another object of the present invention is to facilitate the finishing of a great square footage of plastic concrete with a minimum of personnel, and with minimal repetitive operations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
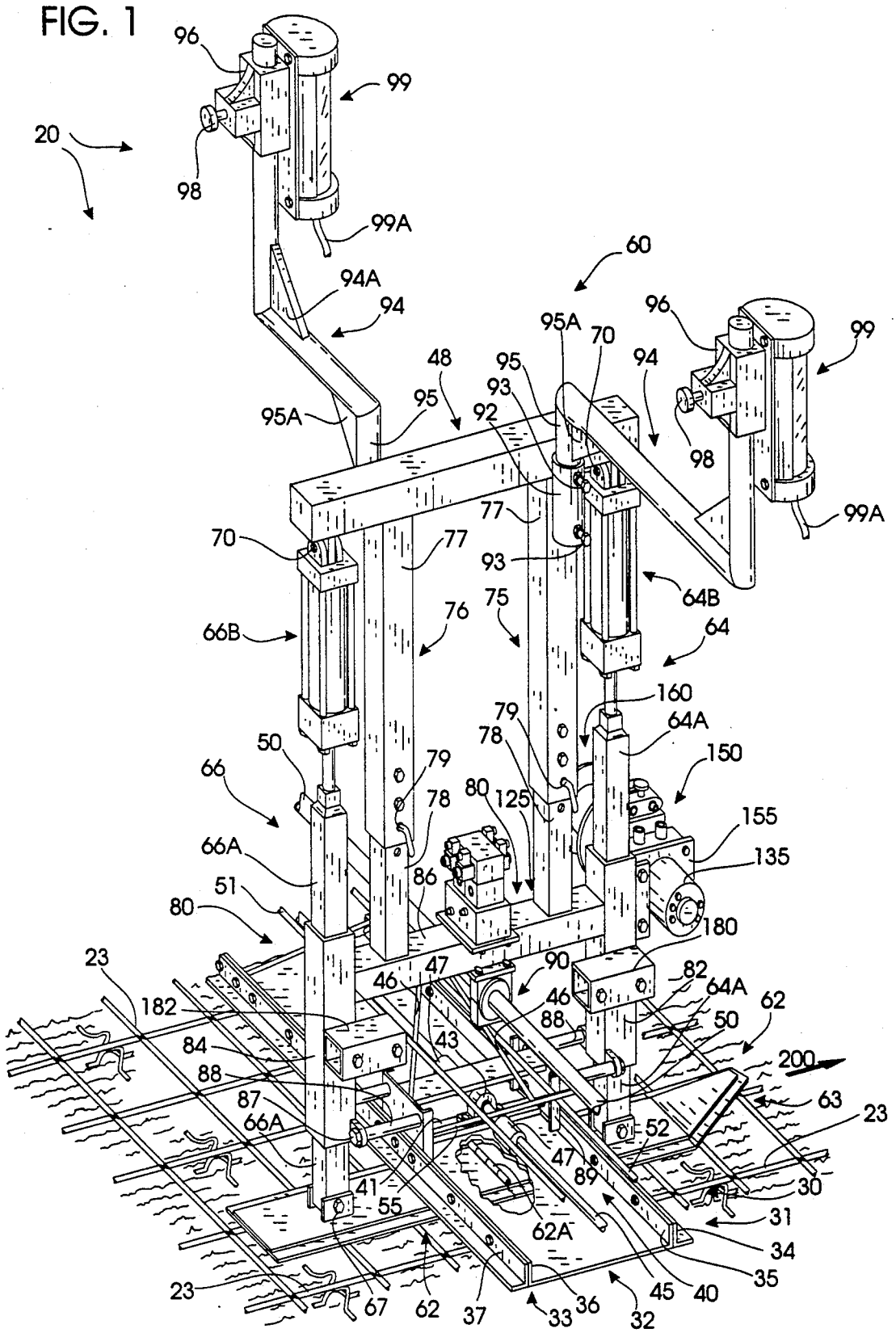
FIG. 1 is a fragmentary, perspective view of the best mode of my Torsional Automatic Grade Control System for Concrete Finishing.
Figure 2:
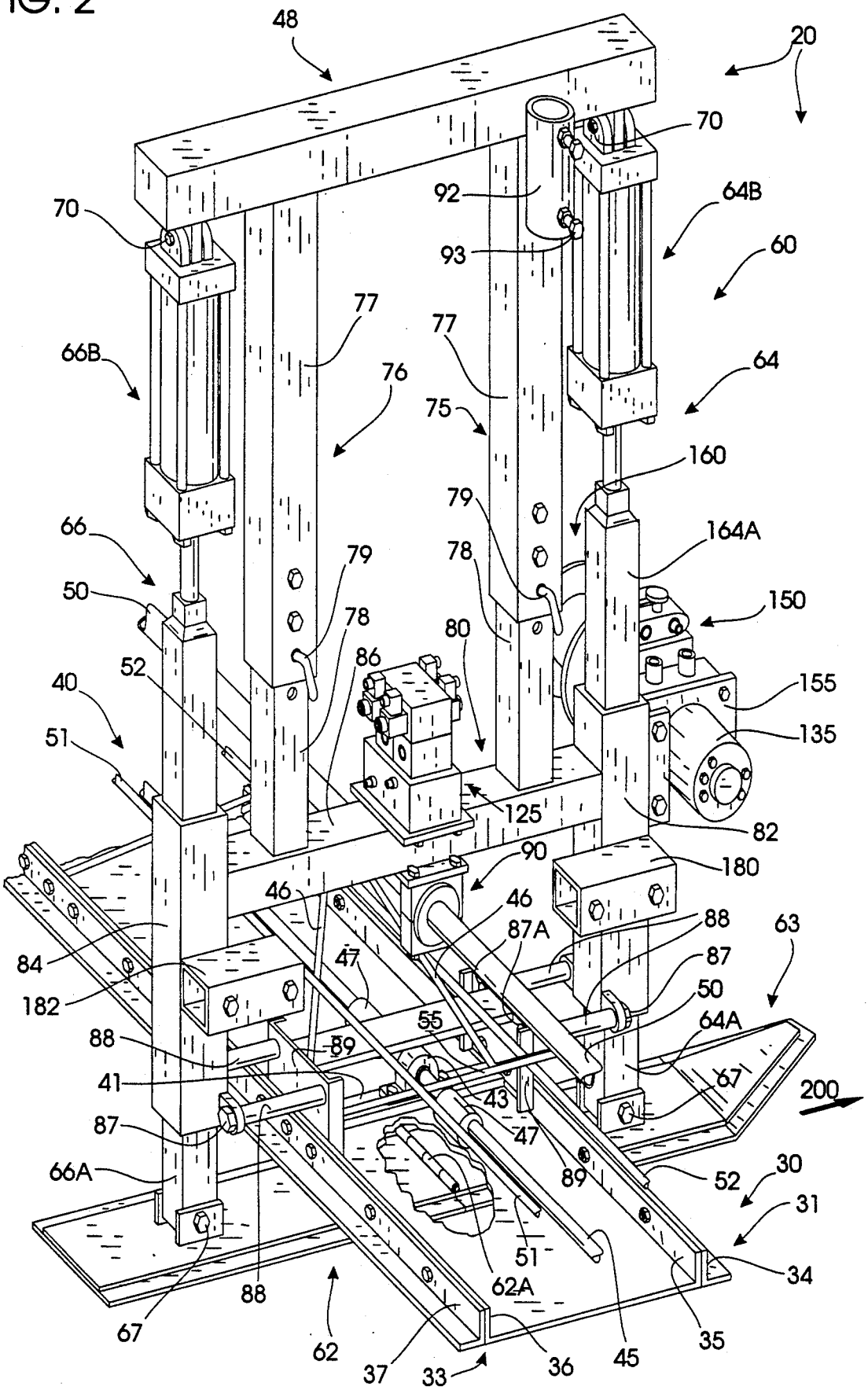
FIG. 2 is an enlarged fragmentary, perspective view with portions omitted for clarity.
Figure 3:
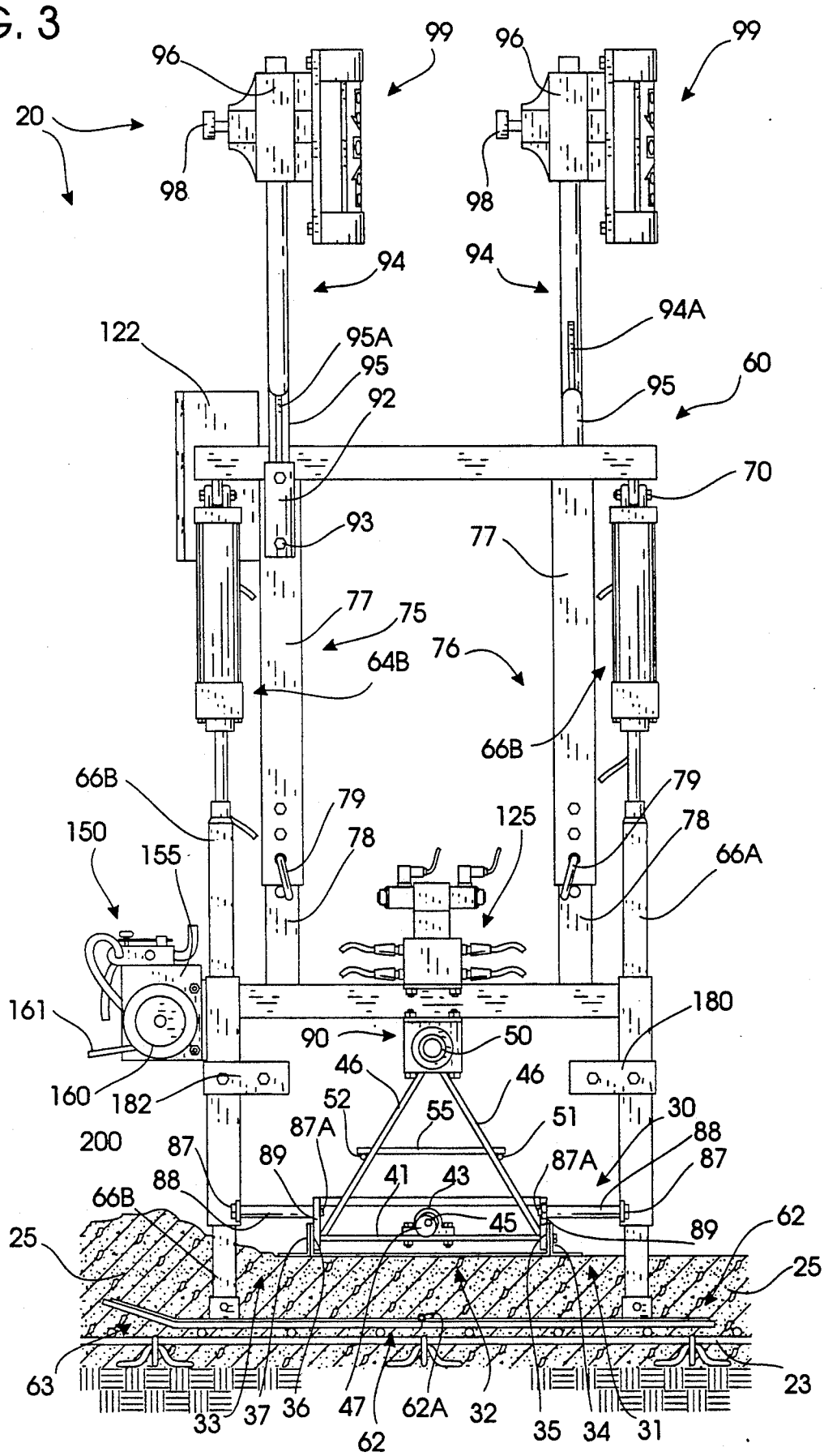
FIG. 3 is a fragmentary left side elevational view.
Figure 4:
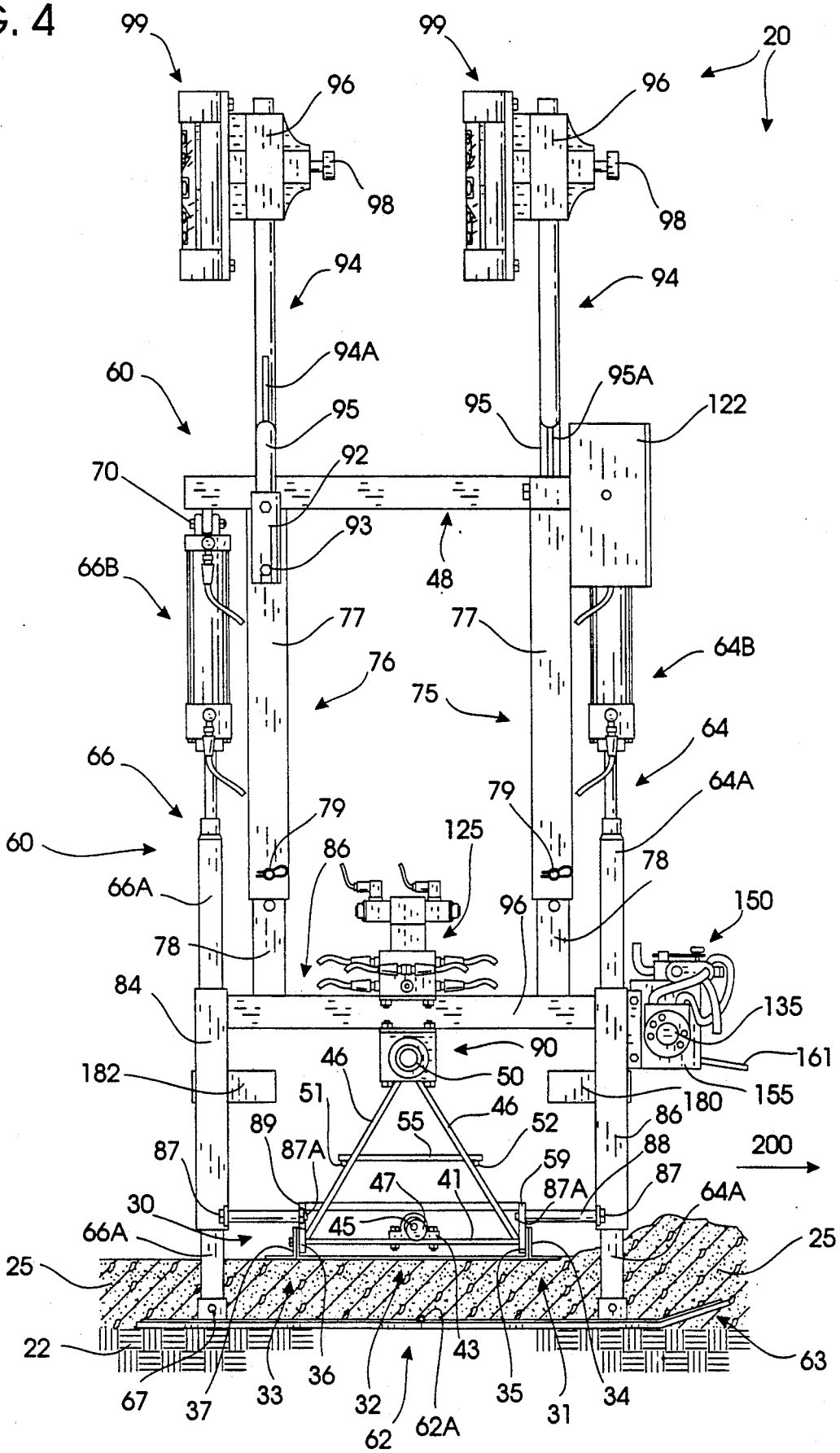
FIG. 4 is a fragmentary right side elevational view.
Figure 5:
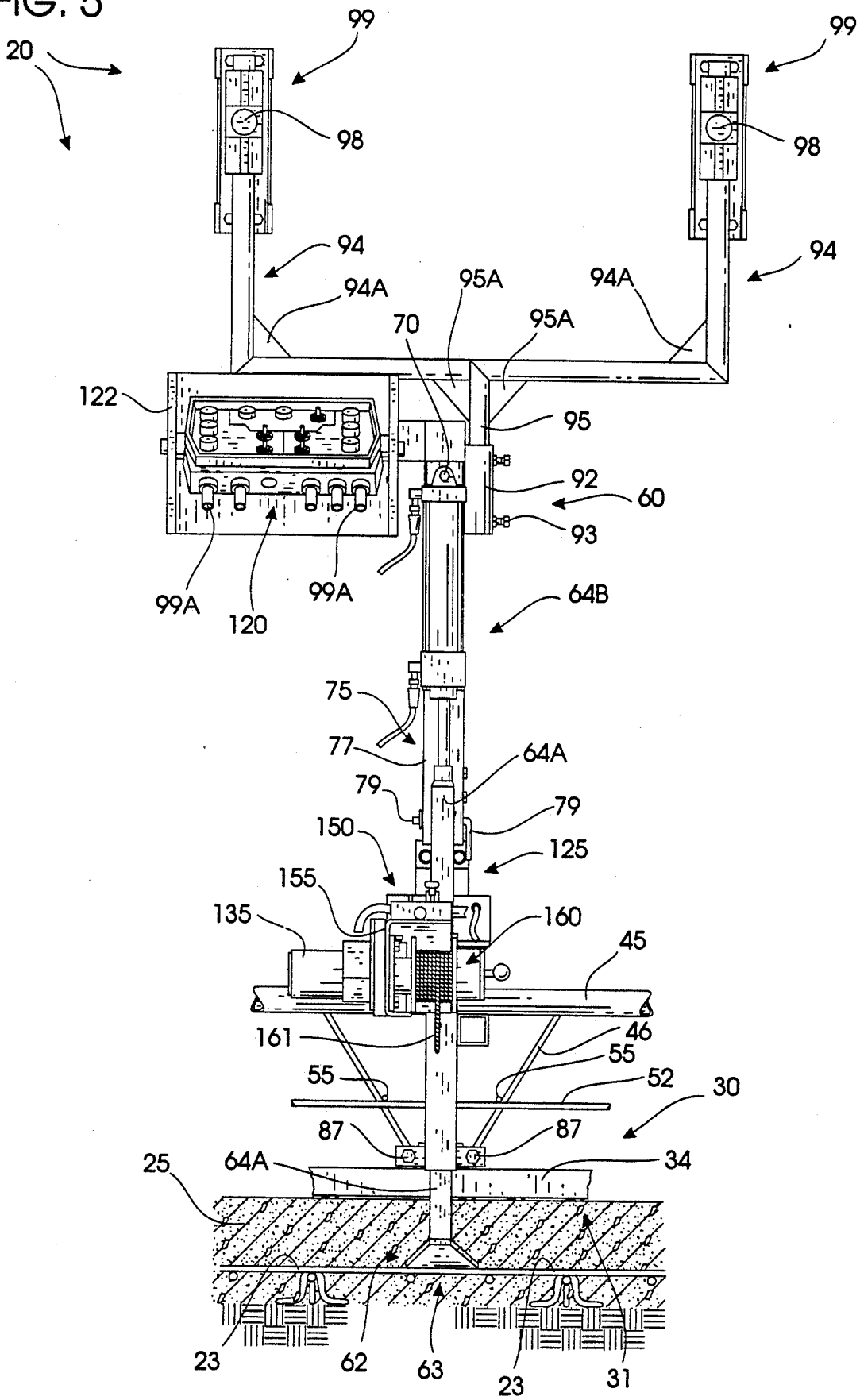
FIG. 5 is a front elevational view.
Figure 6:
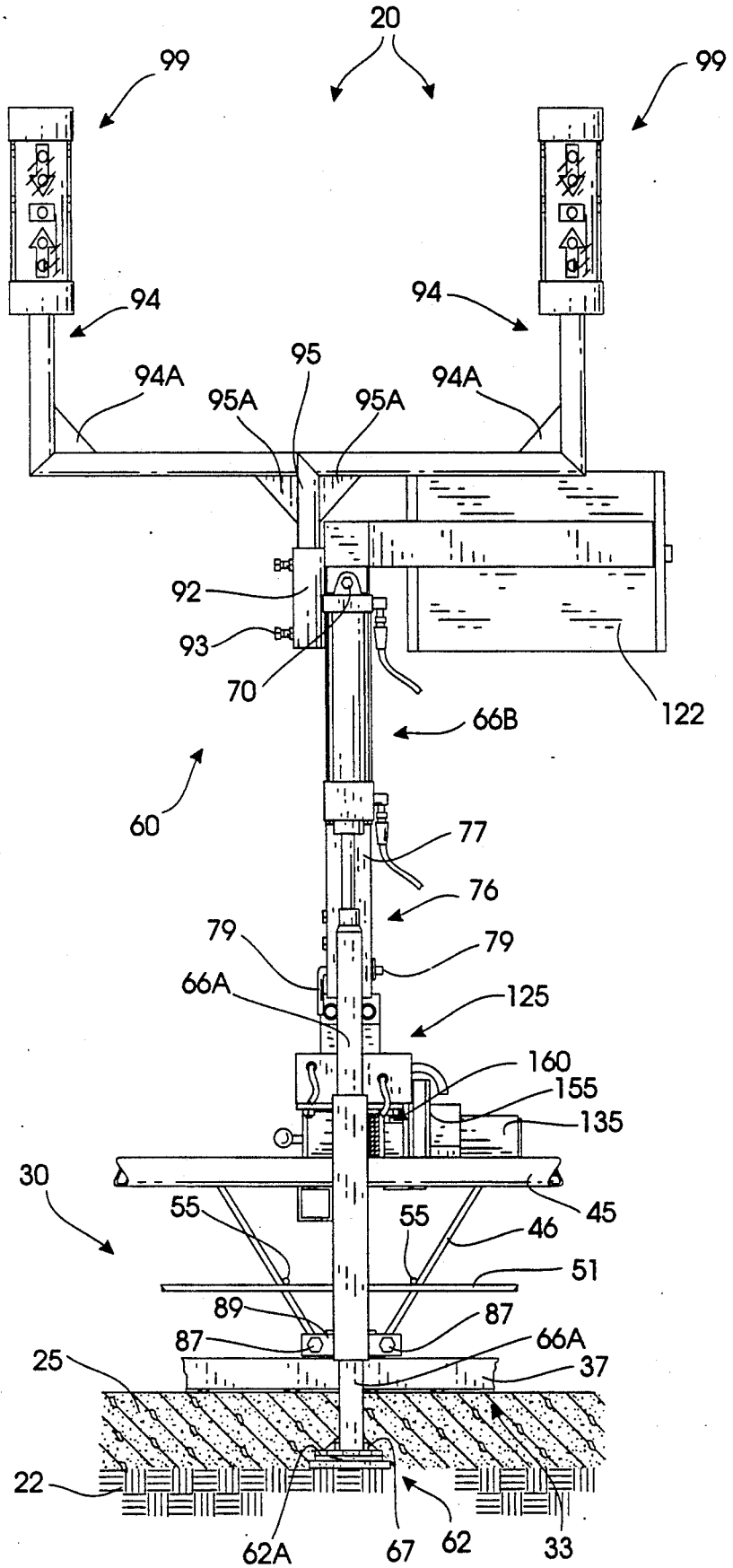
FIG. 6 is a rear elevational view.

Turning now to the drawings, the preferred embodiment of my Laser Operated Automatic Grade Control System for Concrete Finishing is broadly designated by the reference numeral 20. Device 20 is adapted to finish concrete 25 by passing an elongated concrete finishing mechanism such as a vibratory screed 30 over freshly placed, plastic concrete 25. The device rides on the sub-grade 22 or preinstalled rebar 23 (FIGS. 3 and 4), skidding along in the direction indicated by arrows 200 (FIG. 1). The elongated concrete finishing mechanism 30 is operationally suspended between two or more spaced apart tower assemblies 60. The tower assemblies 60 are pivotally pinned at each side to hinged skis 62 for skidding movement. The towers 60 independently operate to control the elevation and torsional displacement of the finishing mechanism 30 that extends between and beneath them. Therefore, as the finishing device 20 moves through and over the plastic concrete 25, it establishes a desired grade with little variation.

The illustrated concrete finishing mechanism 30 is a screed, but a strike-off, a float, or other bladed finishing device may be used. As will be recognized by those skilled in the art, such finishing mechanisms are assembled from several sections at the job site to provide the desired length. It is preferred that multiple towers 60 be employed in conjunction with the grading system. The number depends upon application length. The illustrated screed is a modular unit comprising a striking blade 31, a pan float 32 and a bullfloat 33. The blade 31 initially engages the concrete 25 for initial leveling or "striking-off." It is secured to the pan float 32 by a flange 34 that extends upward from the blade's trailing edge. A similar flange 35 extends upward from the pan's leading edge. The pan float 32, in turn, is secured to the bull float 33 by flanges 36 and 37 respectively. The float 33 is employed on the trailing edge of the screed 30 for finishing.

Although screeds and finishing tools of varying cross sections may be employed, screed 30 has an integral triangular-truss frame 40. A frame member 41 extending transversely across the screed 30 is secured to upwardly projecting flanges 34–37 of the screed blade 31, pan 32, and bull float 33. The illustrated screed is vibrated by an eccentrically weighted shaft 45. A bearing housing 43 mounted on the frame member 41 houses the drive shaft 45. The drive shaft 45 is equipped with weighted eccentrics 47 on either side of the bearing housing 43. When the shaft is driven, vibration is imparted to the screed 30 through the bearing housing 43 and frame member 41, to aid in the compaction and finishing of the plastic concrete 25. Alternatively, multiple spaced apart pneumatic or electric vibrators are employed. The screed frame 40 further comprises trusses 46 angularly extending from the intersection of the frame member 41 and the flanges 34–37 to a frame apex pipe 50. Stringers 51 and 52 run generally parallel with and perpendicular to the apex pipe 50 and are secured to the trusses 46. Spars 55 extend between the junctions of the stringers 51 or 52 with the trusses 46.

The concrete finishing tool 30 is supported at spaced apart intervals by the tower assemblies 60. Each tower assembly 60 generally comprises a hinged ski 62 and a pair of extensible stanchions 64, 66. One forward stanchion 64 and one rear stanchion 66 extend upwardly from the ski 62. An upper strut 48 extends between the stanchions 64 and 66 forming the top of the tower. The ski 62 rides on the sub-grade 22 or rebar 23 below the surface of the concrete 25. Each ski 62 comprises an elongated, generally rectangular section of steel plate having an upturned forward end 63. A hinge 62A is disposed at the center of the ski 62. The hinge 62A is oriented generally parallel with the longitudinal axis of the screed 30A. The lower portions of the stanchions 64A and 66A are constructed of square steel tubing. The upper portions comprise extensible cylinders 64B, 66B, that are preferably hydraulic. The lower extremes of the stanchions 64A, 66A are secured to the ski 62 by pins 67. The pins 67 are oriented parallel to the longitudinal axis 30A of the screed 30 and to the ski hinge 62A allowing the stanchions 64, 66 to pivot. The top strut 48 is pinned to the upper extreme of the extensible stanchions 64, 66. The strut to stanchion pins 70 are oriented perpendicularly relative to the stanchion ski pins 67.

A bridge assembly 80 extends from one stanchion 64, 66 to the other. It comprises a forward box tubing sleeve 82 and a rear box tubing sleeve 84, which are slidably, coaxially fitted to stanchions 64 and 66 respectively. The latter sleeves are welded to a transverse bridge 86, that extends between the sleeves. The sleeves 82 and 84 slide over the stanchions 64 and 66. Adjustable length columns 75, 76 extend from the bridge 86 to the strut 48. Each column comprises an upper housing 77 welded to the upper strut 48 and a lower post 78 welded to the bridge. The upper housing 77 receives the post 78. Coincident orifices are defined in the housing 77 and the post 78. L-pins 79 are placed through the orifices to adjust the distance between the strut 48 and the bridge 86. Tubular mounts 180, 182 are secured to the sleeves 82, 84 to receive dolly wheels or other handling mechanism.

A collar 90 secures the apex pipe 50 of the screed frame 40 to the underside of bridge 86. A tubular, threaded boss 88 is secured on each side of the lower extremes of the sleeves 82 and 84. These tubular bosses 88 define orifices extending generally perpendicular to the screed 30. Bolts 87 pass through the bosses 88 through a bracket 89 secured to the screed flanges 34–37. Nuts 87A secure the screed 30 to the bridge assembly 80.

A mounting socket 92 is secured to the upper housing 77 of each column and the associated portion of the strut 48. Each of these sockets 92 receive a shaft 95 extending downwardly from an L-shaped mast 94. The mast 94 is reinforced by gussets 94A, 95A. Bolts 93 secure the shaft 95 in the socket 92. An adjustable housing 96 mounts a laser sensor 99 to each mast 94. A knobbed screw 98 allows vertical and radial adjustment of the housing 96 and thereby the laser sensor 99. Each sensor 99 is connected by way of cable 99A to the control panel 120.

Each control panel 120 senses information from two laser sensors. A control panel is preferably associated with each tower assembly. The device preferably employs two or more tower assemblies 60 and attendant sensors 99. The electromechanical and hydraulic controls for the present device take a variety of forms consistent with those outlined in my previously referenced patent entitled Laser Operated Automatic Grade Control System for Concrete Finishing.

A shock-mounted bracket 122 on each tower 60 mounts the control panel 120. The controls translate the data received from the sensors 99, via cable 99A, and continuous correction signals are derived. This control information ultimately extends or retracts the stanchions 64 or 66 immediately adjacent the sensor by controlling electric-hydraulic control valves 125. The cylinder controls are interconnected to the speed control valves 150 for the winch 160.

The winch 160 is preferably mounted to the forward bridge sleeve 82 by a flange 155. The winch 160 spools a cable 161 that is secured to a fixed remote point. The winch 160 moves the device 20 along the plastic concrete 25 to be surfaced or treated.

OPERATION

The skis 62 will support the screed 30 to ride over subgrade 22 or rebars 23. The skis 62 provide stability as well as support. Pans can be employed on the ends of the screed to provide finished edges. Skis 62 are used when the concrete being finished will have a wet joint interface with other concrete or it interfaces with a wall surface or against an isolation joint or key lock form. The stanchions 64, 66 run through the concrete being finished. A finishing pass by a bullfloat will cover any trace of grout seams left by the passing ski 62 and stanchions 64, 66. Other paving jobs may require outboard wheels attached to the tower mounts 180, 182.

The screed 30 should first be assembled on a flat surface. Straightness should be checked with the screed 30 resting in its operating position on the subgrade 22. A stringline or wire line may be used to carefully check straightness, joint closure and twist of the screed 30. Any irregularities remaining in the screed blade profile will transfer to the finished concrete.

A number of the above described tower assemblies 60 are necessary to control a screed 30. Generally at least two units are utilized. With the screed 30 in place on the subgrade 22, the screed 30 is adjusted to the desired slab thickness. Next, the elevation of the screed 30 is fixed relative to the sensors 99. In other words, the screed 30 is always the same distance below the sensor 99. During set up the length of the columns 75, 76 is adjusted to ensure the hydraulic cylinders 64B, 66B which make up the upper portion of the stanchions 64, 66 have sufficient travel in both directions. Hence, once set up, the hydraulic piston rod should be at one half stroke. Therefore, adequate stroke will be available during automatic grade control finishing to accommodate screed travel while the skis 62 are extended and/or retracted while negotiating the uneven subgrade. If height adjustments are required, the end of the screed 30 can be lifted with a hydraulic floor jack, and the L-pins 79 from the columns 75, 76 can be repositioned for acceptable clearance. Alternatively, screw jacks may be fitted to the towers 60 to facilitate height adjustments.

The device 20 is controlled by a laser beacon of a conventional design such as Models LB-1 or LB-4 offered by Laser Alignment Inc. The beacon is deployed using a benchmark reference to establish a fixed elevation. Furthermore, the beacon can be established at an angle to facilitate finishing concrete 25 at a predetermined crossfall grade. The laser beacon creates a plane of laser light at a fixed elevation and angle which the sensors 99 of the device 20 will detect.

Thereafter, it is necessary to adjust the sensor 99 upon the mast 94 to obtain initial alignment of the laser and the sensor 99. The sensor 99 must be situated so that it is in line of sight with the beacon throughout the pour. Sensor 99 height and position are easily positioned on the mast 94 and fixed in place utilizing the appropriate screw adjustments 98.

Functionality of the device is checked by levering or tilting a ski 62. The screed 30 should remain at finish grade level. The desired travel speed is set at the hydraulic winches 160, and a trial run of several feet is commenced to insure that everything is functioning properly. As the device 20 is towed with its attached tool over the surface of the concrete 25 by the winch 160, the sensors 99 receive the light beam and adjust the system to maintain the sensor relative to the light beam. The control panel 120 receives the sensor output and provides the necessary instructions to control the elevation of the tool via the hydraulic cylinder controls and thereby the extensible stanchions 64, 66.

With the screed 30 at its starting position, the first batch of concrete is placed, and screed vibration is commenced. The degree of vibration will depend upon concrete slump and admix properties. With plastic concrete in place across the forward blade 31, the travel speed of each winch 160 is adjusted to maintain the screed 30 perpendicular to the direction of travel. Low slump and dry mix ratios will affect screed vibration amplitude and travel speed. As the screed 30 progresses, grade, flatness and levelness should periodically be rechecked.

To provide a good finish, the strike-off blade should be fed one and a half to two and a half inches of surcharge. This surcharge results in a dense, uniform struck-off concrete mass. The aggregate is directed downwardly by the strike-off blade, leaving a dense, struck off surface. The surcharge serves to fill any surface voids and provides a dense, uniform floated finished concrete surface.

Finish grades which incorporate crossfall must be monitored. Screed vibration tends to cause the slab monolith to settle and slump downwardly. If a crossfall is required, then the high side may require some hand work to maintain the desired grade and the low side may need to be restruck by hand.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A laser-operated, automatic grade control device for striking-off, leveling, finishing, surfacing or treating plastic concrete with or without forms, said device comprising:

an elongated concrete finishing mechanism adapted to be deployed in physical contact with said concrete for treating same, said finishing mechanism comprising a front, a rear, a longitudinal axis and a pair of spaced-apart ends;

stanchion means disposed at each end of said finishing mechanism for supporting the device, said stanchion means comprising a stanchion extending upwardly adjacent said front and a stanchion extending upwardly adjacent said rear;

means for dynamically coupling said finishing mechanism to said stanchion means;

means supporting said device for enabling it to be moved over the concrete to be treated, said support means oriented generally perpendicularly to said finishing mechanism;

displacement means at each end of said finishing mechanism for independently vertically displacing each end of said finishing mechanism;

laser means maintained at a fixed elevation for providing a reference level; and, control means for independently controlling extension and retraction of each of said displacement means responsive to said laser means, thereby orienting the finishing mechanism up and down relative to said concrete and torsionally relative to said longitudinal axis to provide a level concrete surface in response to independent elongation or contraction of said displacement means.

2. The device as defined in claim 1 wherein said displacement means comprises a unitary sled near each of said finishing mechanism ends, and each sled comprises a central flexible joint dynamically dividing the sled into two segments.

3. The device as defined in claim 2 wherein said means for dynamically coupling said finishing mechanism to said stanchion means comprises truss means for supporting the finishing mechanism, said truss means comprising slidable sleeve means generally coaxially fitted to said stanchion means.

4. The device as defined in claim 3 wherein said truss means comprises an elongated truss extending generally horizontally over said finishing mechanism between said sleeves.

5. The device as defined in claim 1 wherein said finishing mechanism is a screed comprising:

strike-off blade means for cutting, striking off and leveling rough concrete;

pan means for finishing said concrete; and, vibrator means for vibrating said screed.

6. A laser-operated, automatic grade control device for finishing, surfacing or treating plastic concrete with or without forms, said device comprising:

an elongated concrete finishing mechanism adapted to be deployed in physical contact with said concrete for treating same, said finishing mechanism comprising a leading edge, a trailing edge, a longitudinal axis, a pair of spaced-apart ends, and a generally rectangular finishing plane defined between said leading and trailing edges and said ends; and, a suspension tower adjacent each of said spaced apart ends for supporting said finishing mechanism, said tower comprising:

a pair of upwardly extending extensible and contractible stanchions, a stanchion disposed adjacent said leading edge of said finishing mechanism, and a stanchion disposed adjacent said trailing edge of said finishing mechanism; and, means for dynamically coupling said finishing mechanism to said stanchions;

laser means maintained at a fixed elevation for providing a reference level;

control means for independently controlling extension and retraction of each of said stanchions responsive to said laser means, thereby orienting the finishing mechanism up and down and torsionally about said longitudinal axis to provide a level concrete surface; and, sled means for supporting each of said towers, said sled means oriented generally perpendicularly to said finishing mechanism, said sled means normally sliding below the concrete surface to be finished.

7. The device as defined in claim 6 wherein said sled means comprises a unitary sled near each of said finishing mechanism ends, and each sled comprises a center hinge oriented generally parallel with said longitudinal axis to dynamically divide the sled into two segments.

8. The device as defined in claim 7 wherein said means for dynamically coupling said finishing mechanism to said stanchions comprises:

a slidable sleeve generally coaxially fitted about each of said stanchions;

a truss extending between said sleeves; and, means coupling said truss to said finishing mechanism.

9. The device as defined in claim 8 wherein said means for dynamically coupling said finishing mechanism to said stanchions further comprises:

an upper strut extending between said stanchions; and, column means extending from said upper strut to said truss for supporting same.

10. The device as defined in claim 6 wherein said stanchions are elongated or contracted by hydraulic cylinders.

11. The device as defined in claim 10 wherein said finishing mechanism is a screed comprising:

blade means for cutting, striking off and leveling rough concrete;

bull float means for finishing said concrete; and, vibrator means for vibrating said screed.

12. A laser-operated, automatic grade control device for placing, finishing, surfacing or treating wet, plastic concrete with or without forms, said device comprising:

an elongated concrete finishing mechanism adapted to be deployed in physical contact with said concrete for treating same, said finishing mechanism comprising a leading edge, a trailing edge, a longitudinal axis, a pair of spaced-apart ends, and a generally rectangular finishing plane defined between said leading and trailing edges and said ends; and, a suspension tower adjacent each of said spaced apart ends for supporting said finishing mechanism, said tower comprising:

an upwardly extending extensible and contractible cylinder disposed adjacent each edge of said finishing mechanism;

means for dynamically coupling said finishing mechanism to said cylinders; and, support means near each of said finishing mechanism ends for dynamically supporting each tower;

laser means maintained at a fixed elevation for providing a reference level;

control means for independently controlling extension and retraction of each of said cylinders responsive to said laser means, thereby orienting the finishing mechanism up and down and torsionally to provide a level concrete surface; and, means for displacing said device relative to the concrete to be finished.

13. The device as defined in claim 12 wherein said support means comprises a flexible sled comprising two cooperating segments.

14. The device as defined in claim 12 wherein said means for dynamically coupling said finishing mechanism to said cylinders comprises:

a slidable sleeve on each side of each tower;

a truss extending between said sleeves; and, means coupling said truss to said finishing mechanism.

15. The device as defined in claim 14 wherein said means for dynamically coupling said finishing mechanism to said cylinders further comprises an upper strut and column means extending from said upper strut to said truss for supporting same.

16. The device as defined in claim 15 wherein said finishing mechanism is a screed comprising:

strike-off means for cutting, striking off and leveling rough concrete;

float means for finishing said concrete; and, vibration means for vibrating said screed to facilitate consolidation of said concrete.

17. The device as defined in claim 12 wherein said cylinders control stanchions that are elongated or contracted to control the finishing mechanism.

18. The device as defined in claim 17 wherein said means for dynamically coupling said finishing mechanism to said cylinders comprises:

a slidable sleeve on each stanchion;

a truss extending between said sleeves; and, means coupling said truss to said finishing mechanism.

19. The device as defined in claim 18 wherein said means for dynamically coupling said finishing mechanism to said cylinders further comprises an upper strut and column means extending from said upper strut to said truss for supporting same.

* * * * *